US006880513B1

(12) United States Patent
Komatsu et al.

(10) Patent No.: US 6,880,513 B1
(45) Date of Patent: Apr. 19, 2005

(54) ENGINE BLOCK

(75) Inventors: Haruhiko Komatsu, Wako (JP); Tsuneo Endoh, Wako (JP); Tsuyoshi Baba, Wako (JP); Yuichi Itoh, Wako (JP); Tosio Takamoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 446 days.

(21) Appl. No.: 10/110,768

(22) PCT Filed: Oct. 23, 2000

(86) PCT No.: PCT/JP00/07382

§ 371 (c)(1),
(2), (4) Date: Apr. 25, 2002

(87) PCT Pub. No.: WO01/31186

PCT Pub. Date: May 3, 2001

(30) Foreign Application Priority Data

Oct. 26, 1999 (JP) ..... 11/304578

(51) Int. Cl.[7] ..... F02F 7/00
(52) U.S. Cl. ..... 123/195 R
(58) Field of Search ..... 123/195 R

(56) References Cited

U.S. PATENT DOCUMENTS 3,166,992 A * 1/1965 Francis ..... 123/195 R
4,748,948 A 6/1988 Burgio Di Aragona

FOREIGN PATENT DOCUMENTS

| | | |
|---|---|---|
| FR | 822 784 A | 1/1938 |
| JP | 59-219513 | 12/1984 |
| JP | 60-81451 | 5/1985 |
| JP | 64-37590 | 3/1989 |

* cited by examiner

*Primary Examiner*—Noah P. Kamen
(74) *Attorney, Agent, or Firm*—Arent Fox PLLC

(57) ABSTRACT

An engine block includes a cylinder head, a plurality of bearing caps for a crankshaft, a cylinder block disposed between the cylinder head and the bearing caps, a plurality of fastening members for fastening the cylinder head and the bearing caps to each other, and a plurality of columnar members interposed between the cylinder head and the bearing caps to receive the fastening forces of the fastening members. Thus, it is possible to provide an engine block including a cylinder block reduced in weight by a remarkable reduction in required strength.

4 Claims, 6 Drawing Sheets

ENGINE BLOCK

FIELD OF THE INVENTION

The present invention relates to an engine block and particularly, to an engine block including a cylinder head, a cylinder block and a plurality of bearing caps for a crankshaft.

BACKGROUND ART

There is such a conventionally known engine block of which cylinder block is comprised of a cylinder block body made of an aluminum alloy, and one or two or more cylinder sleeves of a cast iron formed by casting in the cylinder block body, and to which engine block a cylinder head and bearing caps for a crankshaft are assembled through a plurality of stud bolts provided on the cylinder block.

The conventional engine block suffers from the following problem: An explosion force applied to the cylinder head is received by the cylinder block, and the cylinder block is a member to which the cylinder head and the bearing caps are assembled. Therefore, in order to increase the strength of the cylinder block and thus the strengths of the cylinder block body and the cylinder sleeves, the thickness of them is increased. For this reason, the weight of the cylinder block is increased and hence, it is impossible to meet the demand for a reduction in weight of the engine block.

In a waste heat recovering device for an internal combustion engine utilizing a Rankin cycle, the following problem is encountered: If an exhaust gas from the internal combustion engine is used as a heat source, the higher the temperature of the exhaust gas is, the higher the waste heat recovering efficiency is. If each of the cylinder sleeves of the cast iron is formed by casting in the cylinder block body, as described above, the area of contact of both the members with each other is increased. For this reason, the heat of the exhaust gas is partially diffused from the cylinder sleeves through the cylinder block body, and as a result, the temperature of the exhaust gas dropps.

DISCLOSURE OF THE INVENTION

It is an object of the present invention to provide an engine block of the above-described type including a cylinder block reduced in weight.

To achieve the above object, according to the present invention, there is provided an engine block comprising a cylinder head, a plurality of bearing caps for a crankshaft, a cylinder block disposed between the cylinder head and the bearing caps, a plurality of fastening members for fastening the cylinder head and the bearing caps to each other, and a plurality of columnar members interposed between the cylinder head and the bearing caps to receive the fastening forces of the fastening members.

With the above arrangement, it is possible to reduce the required strength of the cylinder block remarkably and hence, it is possible to decrease the thickness of the cylinder block to provide a reduction in weight thereof.

It is another object of the present invention to provide an engine block of the above-described type, wherein the temperature of an exhaust gas can be maintained at a high level.

To achieve the above object, according to the present invention, there is provided an engine block wherein the cylinder block includes a cylinder block body, and at least one cylinder sleeve fitted into the cylinder block body with a portion of an outer peripheral surface thereof retained in the cylinder block body.

With the above arrangement, the area of contact of the cylinder block body and the cylinder sleeve with each other can be reduced remarkably and hence, it is possible to inhibit the diffusion of heat of an exhaust gas leading to the cylinder block to a large extent to maintain the temperature of the exhaust gas at a high level. The engine block is suitable as a waste heat recovering device for an internal combustion engine utilizing a Rankin cycle.

It is a further object of the present invention to provide an engine block of the above-described type, wherein the life of a bearing for a crankshaft can be prolonged.

To achieve the above object, according to the present invention, there is provided an engine block, wherein each of the fastening members has a U-bolt, and each of the bearing caps has a curved groove which is brought into surface contact with a curved portion of the U-bolt.

With the above arrangement, a radial load applied to a bearing (metal) can be dispersed widely from a curved groove-defining portion of each of the bearing caps, thereby prolonging the life of a bearing for the crankshaft.

BEST MODE FOR CARRYING OUT THE INVENTION

Figure 1:
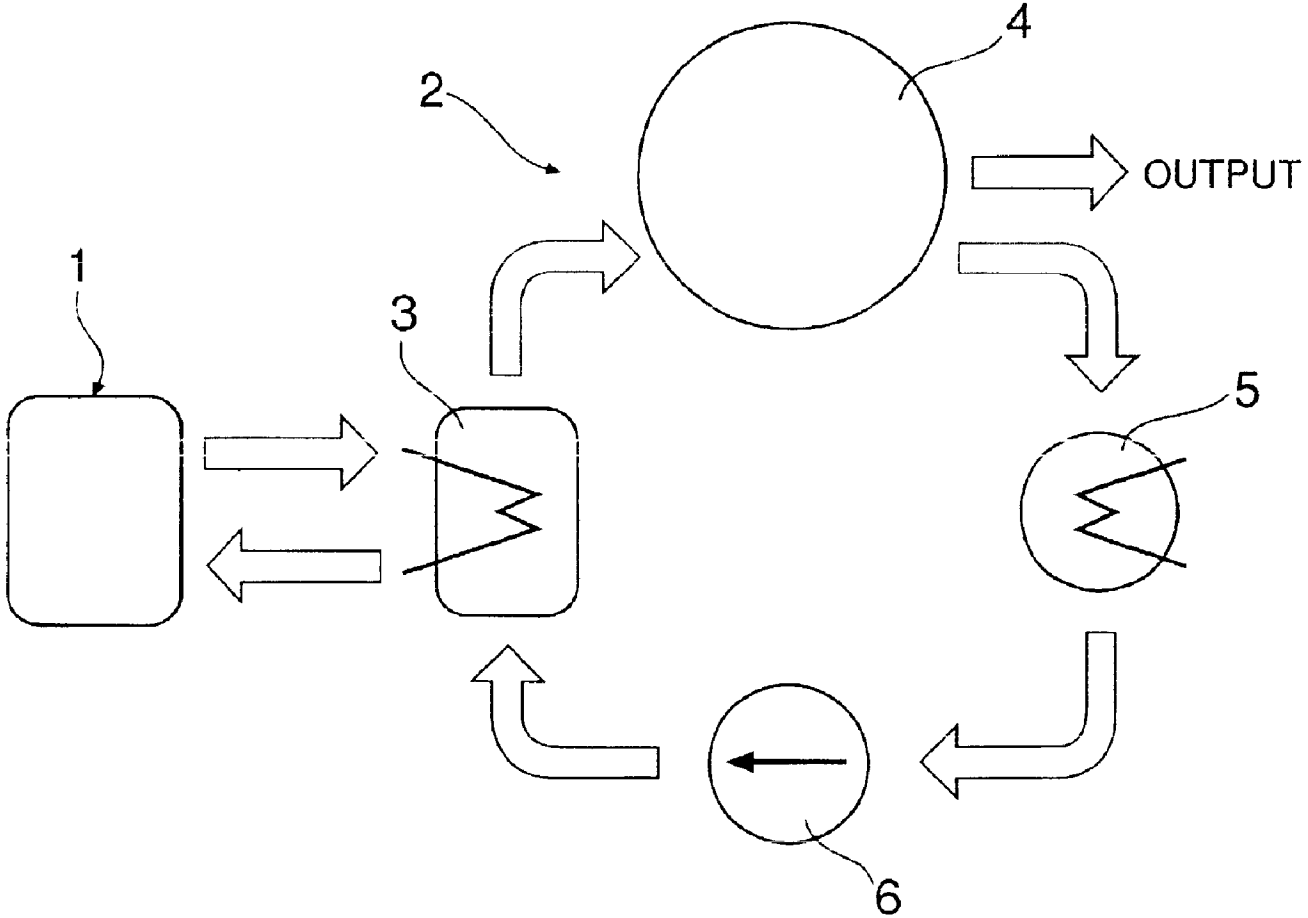
FIG. 1 is a schematic illustration of a waste heat recovering device for an internal combustion engine.

Referring to FIG. 1, a waste heat recovering device 2 for an internal combustion engine 1 utilizing a Rankin cycle includes an evaporator 3 for generating a high-pressure vapor using a waste heat from the internal combustion engine 1, e.g., an exhaust gas as a heat source, an expander 4 for expanding the high-pressure vapor to provide an output, a condenser 5 for liquefying a low-pressure vapor discharged from the expander 4, and a water supply pump 6 for supplying water in the condenser 5 to the evaporator 3.

Figure 2:
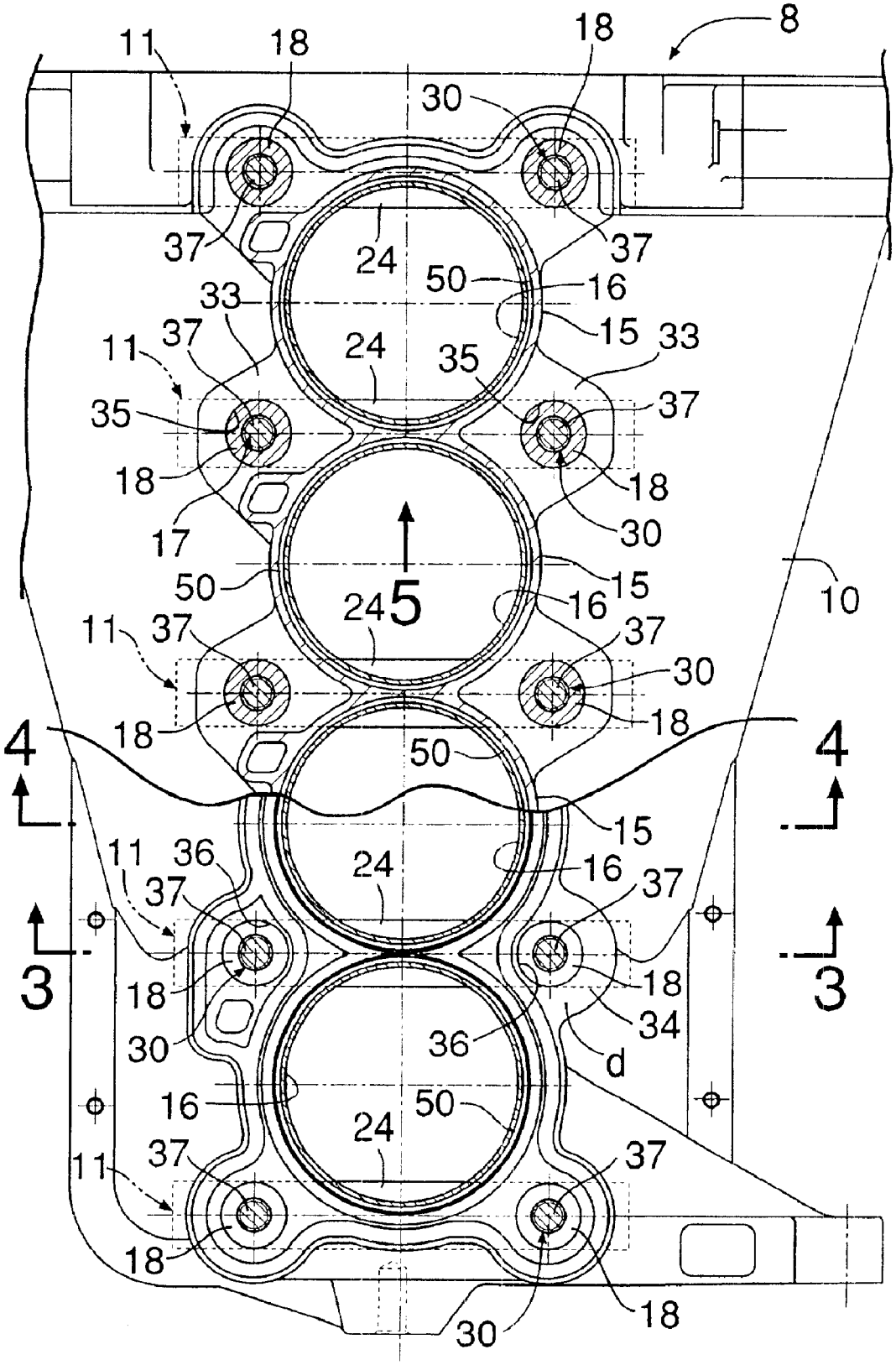
FIG. 2 is a cutaway plan view of essential portions of a cylinder block.
Figure 3:
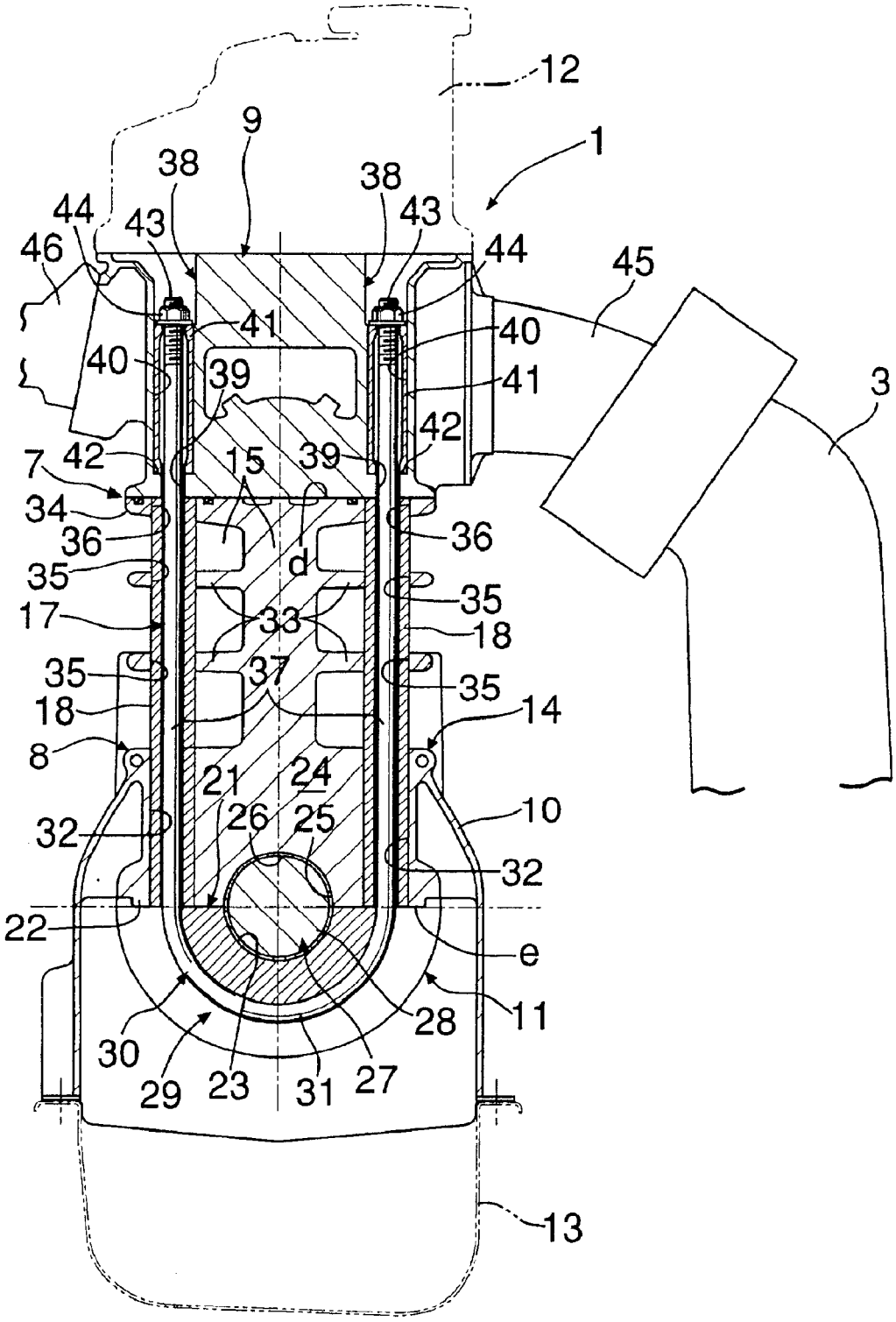
FIG. 3 is a sectional view of an engine block, taken along a line 3—3 in FIG. 2.
Figure 4:
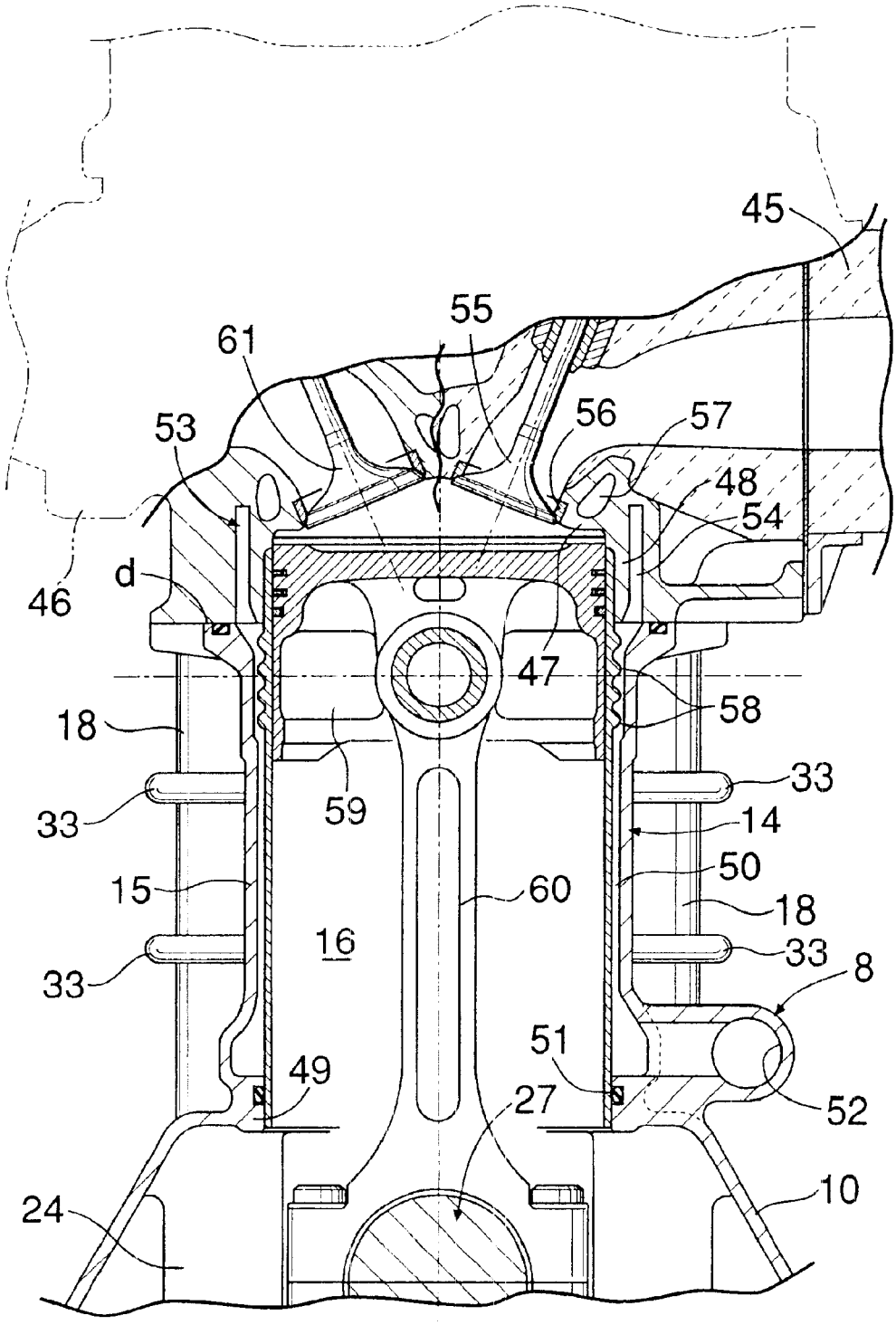
FIG. 4 is a sectional view of an internal combustion engine, taken along a line 4—4 in FIG. 2.

As shown in FIGS. 2 to 4, an engine block 7 in the internal combustion engine, e.g., a 4-cylinder internal combustion engine 1 includes a cylinder block 8, a cylinder head 9 made of an aluminum alloy and disposed at one end of the cylinder block 8, and a plurality of, e.g., five (in the embodiment) crankshaft-bearing caps 11 made of an aluminum alloy and disposed within a crankcase 10 located at the other end of the cylinder block 8. In FIG. 3, reference character 12 is a head cover, and reference character 13 is an oil pan.

The cylinder block 8 includes a cylinder block body 14 made of an aluminum alloy, and four cylinder sleeves 16 made of an cast iron and fitted into four cylinder barrels 15 arranged in one row in the cylinder block body 14. Adjacent ones of the cylinder barrels 15 are connected to each other, and the crankcase 10 is connected to the adjacent cylinder barrels 15.

As best shown in FIG. 2, the five bearing caps 11 are disposed perpendicularly to a direction of arrangement of the cylinder barrels 15 at locations outside the outermost cylinder barrels 15 and at locations corresponding to connections of the adjacent cylinder barrels 15.

As best shown in FIG. 3, the cylinder head 9 and each of the bearing caps 11 are fastened to each other by a plurality of threaded members 17 as fastening members, and a plurality of columnar members 18 made of a stainless steel are interposed between the cylinder head 9 and each of the bearing caps 11 to receive clamping forces of the threaded members 17.

Figure 5:
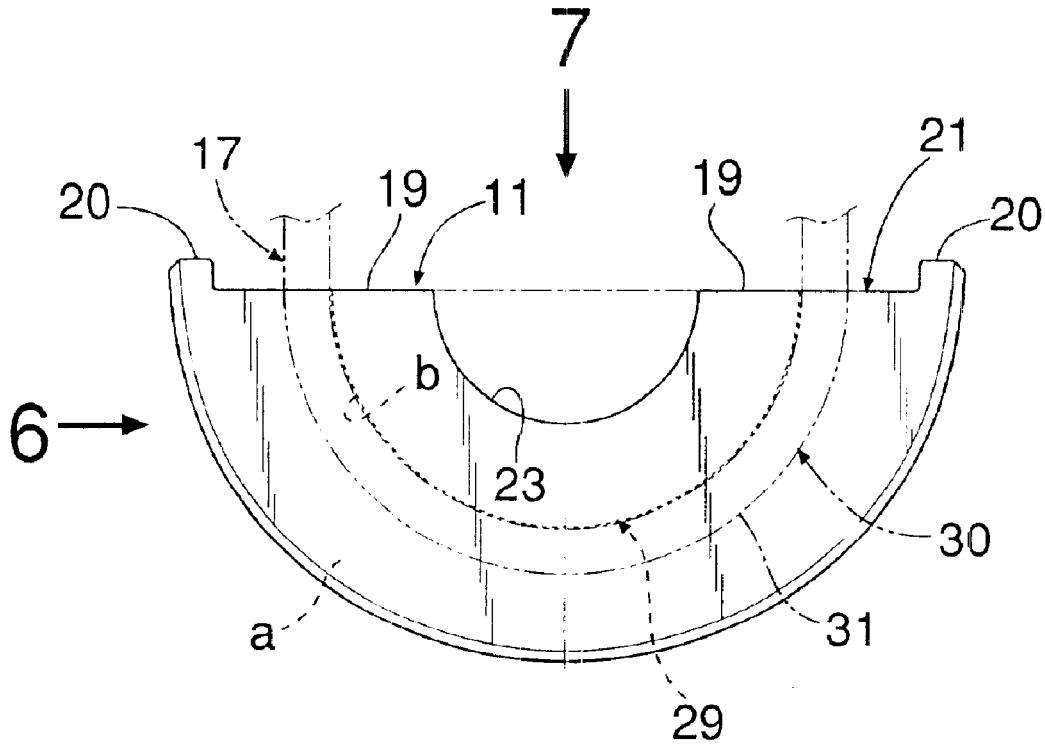
FIG. 5 is a view of a bearing cap, taken in the direction of an arrow 5 in FIG. 2.
Figure 6:
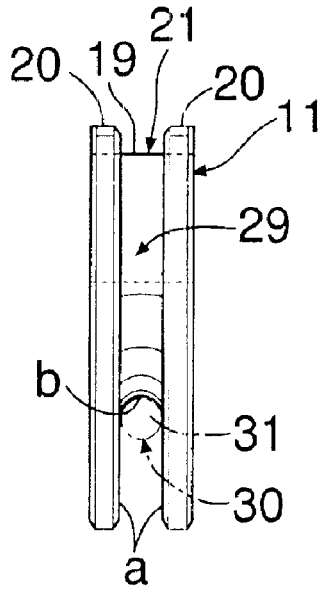
FIG. 6 is a view of the bearing cap, taken in the direction of an arrow 6 in FIG. 5.
Figure 7:
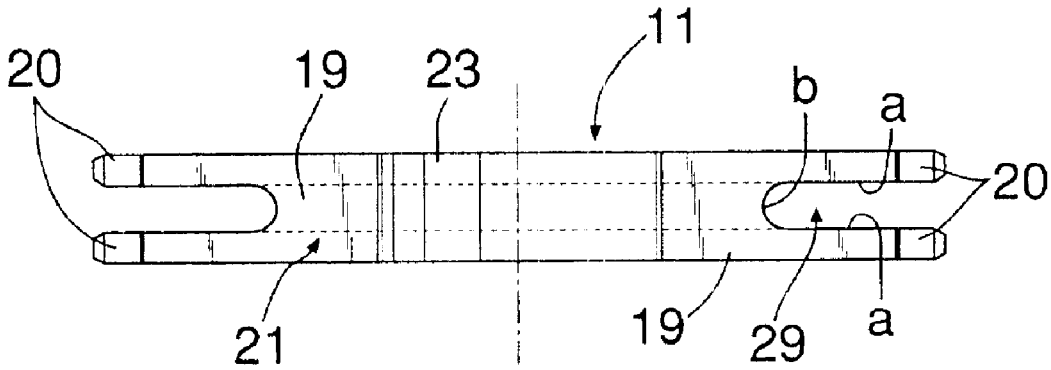
FIG. 7 is a view of the bearing cap, taken in the direction of an arrow 7 in FIG. 5.

As also shown in FIGS. 5 to 7, each of the bearing caps 11 is semi-annular, and a shallow recess 21 defined by each of circumferentially opposite end faces 19 of the bearing cap 11 and two projections 20 provided at outer ends of each of the opposite end faces 19 is fitted over each of shallow projections 22 on the cylinder block body 14. A journal 28 of the crankshaft 27 is rotatably supported, through a bearing (metal) 26, between a semi-arcuate bearing-mounting recess 23 defined between the opposite end faces 19 of each bearing cap 11 and a bearing-mounting recess 25 defined in a journal-supporting wall 21 of the cylinder block body 14 and opposed to the mounting recess 23.

Further, each bearing cap 11 has a semi-arcuate curved groove 29 which opens into an outer peripheral surface of the bearing cap 11 and extends from one of the end faces 19 to the other end face 19, and a semi-arcuate curved portion 31 of a U-bolt 30 constituting the threaded member 17 is fitted into the curved groove 29. An inner surface of the curve groove 29 comprises a pair of inner surface portions a opposed to each other, and a semi-arcuate bottom b connecting the inner surface portions a to each other and mated with the arcuate outer peripheral surface of the U-bolt 30. Thus, the curved portion 31 of the U-bolt 30 is in face contact with the curved groove 29 in the bearing cap 11.

As best shown in FIGS. 2 and 3, two through-bores 32 are provided in the journal-supporting wall 24 of the cylinder block body 14 and open toward the opposite end faces 19 of the bearing cap 11, and through-bores 35 and 36 are defined in a protrusion 33 provided at two stages on the cylinder barrel 15 and in a deck portion 34 of the cylinder head 9, respectively, so that they are located coaxially with the through-bores 32. In this manner, two arrays of the through-bores are provided for every bearing cap 11, and the hollow columnar members 18 are fitted into the arrays of the through-bores. The length of the columnar members 18 is slightly larger than a distance between a deck face d of the cylinder block body 14 and an end face e of the projection 22 provided on the bearing cap 11.

The U-bolt 30 has two parallel portions 37 extending through the hollow columnar members 18 into through-bores 38 in the cylinder head 9, respectively. Each of the through-bores 38 has a smaller-diameter portion 39 which is provided in the cylinder block body 14 and through which corresponding one of the parallel portions 37 is passed, and a larger-diameter portion 40 leading to the smaller-diameter portion 39. A hollow tubular spacer 41 made of a stainless steel is fitted into the larger-diameter portion 40 and mated at one end thereof to an annular stepped face 42 of the smaller-diameter portion 39. Each of the parallel portions 37 has an externally threaded portion 43 protruding from the spacer 41, and a nut 44 forming the threaded member 17 is threadedly fitted over the externally threaded portion 43. In this case, each of the spacers 41 has an effect of facilitating the threaded fitting of the nut 43 from the side of the head cover 12. In FIG. 3, reference character 45 is an exhaust pipe, and the evaporator 3 is mounted to the exhaust pipe 45. Reference character 46 is an intake pipe.

If the engine block is constructed as described above, the clamping force of each of the threaded members 17 cannot be applied to the cylinder block 8 and hence, the required strength of the cylinder block 8 can be reduced substantially. Therefore, the thickness of the cylinder barrels 15 and of the cylinder sleeves 16 can be reduced to provide a reduction in weight of the cylinder block 8.

When the curved portion 31 of the U-bolt 30 and the curved groove 29 in the bearing cap 11 are brought into surface contact with each other, a radial load applied to the bearing 26 can be dispersed widely from a portion of the bearing cap 11 defining the curved groove 29, whereby the life of the bearing 26 can be prolonged.

Further, if the parallel portions 37 of the U-bolt 30 and the hollow columnar members 18 are coaxially arranged in the same numbers, a bending load applied to the cylinder head 9 can be reduced to the utmost.

The five bearing caps 11 may be connected integrally to one another, and such arrangement is effective for enhancing the rigidity of the engine block 7.

Referring to FIGS. 2 and 4, the outer peripheral surface at one end of each of the cylinder sleeves 16 is fitted to an inner peripheral surface of a cylindrical portion 48 leading to each of combustion chamber-defining portions 47 of the cylinder head 9 using a means such as a shrinkage fit. The outer peripheral surface at the other end of each cylinder sleeve 16 is also fitted to an annular protrusion 49 located at an inner end of the corresponding cylinder barrel 15 on the side of the crankcase 10. Thus, a water jacket 50 is defined between the inner peripheral surface of each of the cylinder barrels 15 and the outer peripheral surface of the corresponding cylinder sleeve 16 in a region between the cylindrical portion 48 and the annular protrusion 49 to surround the entire periphery of the cylinder sleeve 16. A seal ring 51 is mounted between the outer peripheral surface at the other end of the cylinder sleeve 16 and an inner peripheral surface of the annular protrusion 49 of the cylinder barrel 15.

Each of the water jackets 50 communicates at one end thereof with a water guide bore 52 leading to a water pump and at the other end thereof with a water passage 54 surrounding the cylindrical portion 48 at a water jacket 53 in the cylinder head 9. The water passage 54 communicates with a water passage 57 surrounding a valve seat 56 of an exhaust valve 55.

A plurality of annular projections 58 are formed on a portion of the outer peripheral surface of each of the cylinder sleeves 16 on the side of the cylinder head 9 and arranged in a direction of a generating line. Each of the annular projections 58 has a substantially semicircular section within a phantom plane including the centerline of the cylinder sleeve. In FIG. 4, reference character 59 is a piston; reference character 60 is connecting rod; and reference character 61 is an intake valve.

If the cylinder block 8 is constructed to have the cylindrical block body 14, and the cylinder sleeves 16 each fitted into corresponding one of the cylinder barrels 15 in the cylinder block body 14 with a portion of its outer peripheral surface retained in the corresponding cylinder barrel 15, the area of contact of the cylindrical block body 14 and each cylinder sleeve 16 with each other can be reduced remarkably. Therefore, it is possible to inhibit the diffusion of heat of an exhaust gas leading to the cylinder block 8 to a large extent to maintain the temperature of the exhaust gas at a high level.

The water jacket 50 is disposed to extend over the entire periphery of each of the cylinder sleeves 16 and therefore, it is possible to cool the whole of the cylinder sleeves 16 to inhibit the thermal strain of each cylinder sleeve 16. Particularly, a portion of each cylinder sleeve 16 in the vicinity of a combustion chamber, which tends to be heated to the highest temperature, can be cooled efficiently by the increase in surface area due to the provision of the plurality of annular projections 58 and by an effect of producing a turbulent flow in cooling water.

Further, it is possible to reduce the thickness of each cylinder barrel 15 and of each cylinder sleeve 16 and hence, even if the water jacket 50 is disposed over the entire periphery of each cylinder sleeve 16, the length of the cylinder block 8 in the direction of arrangement of the cylinder barrels can be shortened, leading to a reduction in size of the cylinder block 8.

INDUSTRIAL APPLICABILITY

The engine block according to the present invention is applicable to a multi-cylinder internal combustion engine and also to a single-cylinder internal combustion engine.

What is claimed is:

1. An engine block comprising a cylinder head, a plurality of bearing caps for a crankshaft, a cylinder block disposed between said cylinder head and said bearing caps and having a cyinder sleeve in which a piston is received, a plurality of fastening members for fastening said cylinder head and said bearing caps to each other, and a plurality of columnar members interposed between said cylinder head and said bearing caps to receive the fastening forces of said fastening members, wherein through-bores are provided in said cylinder block, and said columnar members, which are independent of each other, are fitted into the through-bores.

2. An engine block according to claim 1, wherein said cylinder block includes a cylinder block body, and said cylinder sleeve is fitted into said cylinder block body with a portion of an outer peripheral surface thereof retained in said cylinder block body.

3. An engine block according to claim 1 or 2, wherein each of said fastening members has a U-bolt, and each of said bearing caps has a curved groove which is brought into surface contact with a curved portion of said U-bolt.

4. An engine block according to claim 2, wherein as said cylinder sleeve, a plurality of cylinder sleeves are provided in the engine block.

* * * * *